US008139052B2

(12) United States Patent
Ito

(10) Patent No.: US 8,139,052 B2
(45) Date of Patent: Mar. 20, 2012

(54) ELECTRO-OPTICAL DEVICE, METHOD OF DRIVING ELECTRO-OPTICAL DEVICE, AND ELECTRONIC APPARATUS

(75) Inventor: Akihiko Ito, Tatsuno (JP)

(73) Assignee: Seiko Epson Corporation, Tokyo (JP)

( * ) Notice: Subject to any disclaimer, the term of this patent is extended or adjusted under 35 U.S.C. 154(b) by 1064 days.

(21) Appl. No.: 12/035,006

(22) Filed: Feb. 21, 2008

(65) Prior Publication Data

US 2008/0225024 A1 Sep. 18, 2008

(30) Foreign Application Priority Data

Mar. 13, 2007 (JP) ..... 2007-062978

(51) Int. Cl.
*G09G 5/00* (2006.01)

(52) U.S. Cl. ..... 345/204; 345/76; 345/87; 345/211; 345/690; 315/169.1; 315/169.3

(58) Field of Classification Search ..... 345/87–100, 345/204, 211–213, 690, 38–58, 76–86; 315/169.1–169.4
See application file for complete search history.

(56) References Cited

U.S. PATENT DOCUMENTS

| | | | | |
|---|---|---|---|---|
| 2005/0007392 | A1* | 1/2005 | Kasai et al. | 345/690 |
| 2005/0041488 | A1* | 2/2005 | Ito et al. | 365/199 |
| 2008/0309599 | A1* | 12/2008 | Tsuda et al. | 345/88 |

FOREIGN PATENT DOCUMENTS

| | | |
|---|---|---|
| JP | A-6-34941 | 2/1994 |
| JP | A-2005-43417 | 2/2005 |
| JP | A-2005-43418 | 2/2005 |

* cited by examiner

*Primary Examiner* — Quan-Zhen Wang
*Assistant Examiner* — Jennifer Nguyen
(74) *Attorney, Agent, or Firm* — Oliff & Berridge, PLC

(57) ABSTRACT

An electro-optical device includes data lines divided into groups of M data lines, where N is a natural number equal to or greater than three. Output lines are arranged in correspondence with the data lines and receive, during a predetermined period, output of a correction voltage having a predetermined voltage level and sequential data voltages for defining gray scale levels of the pixels. A time division circuit simultaneously supplies the correction voltage output to the output line to M data lines of each group of data lines, where M is a natural number equal to or greater than two and equal to or less than "N−1".

8 Claims, 9 Drawing Sheets

ELECTRO-OPTICAL DEVICE, METHOD OF DRIVING ELECTRO-OPTICAL DEVICE, AND ELECTRONIC APPARATUS

BACKGROUND

1. Technical Field

The present invention relates to technical fields of an electro-optical device such as a liquid crystal device, a method of driving the electro-optical device, and an electronic apparatus such as a liquid crystal projector having the electro-optical device.

2. Related Art

In electro-optical devices of this type, parasitic capacitance exists between a data line to which a data voltage for regulating a gray scale level of a pixel is supplied and a pixel column connected to the data line. The data line and the pixel column form capacitance coupling through the parasitic capacitance, and there is a case where vertical crosstalk (uneven display in a direction along the data line) is generated due to the capacitive coupling and the like during the operation of the device. In addition, there is a case where the vertical crosstalk is generated due to a gradual variance of a voltage level maintained in a pixel which is influenced by a leakage current (off leak) in a state that a pixel transistor is turned off.

In order to suppress the vertical crosstalk, for example, a method of driving an electro-optical device in which before a data voltage is supplied, a voltage (correction voltage) level having a polarity opposite to that of the data voltage is supplied to a data line in one horizontal scanning period has been disclosed in JP-A-6-34941.

In addition, in JP-A-2005-43417, technology for sequentially supplying a correction voltage level to a plurality of data lines, one at a time has been disclosed. Furthermore, in JP-A-2005-43418, technology for simultaneously supplying a correction voltage to a plurality of data lines has been disclosed.

However, in the above-described technology for sequentially supplying the correction voltage level to a plurality of data lines, one at a time, there are technical problems that a considerable time is required for supplying the correction voltage level to the whole plurality of data lines and that a drive voltage level increases. On the other hand, in the technology for simultaneously supplying the correction voltage level to the plurality of data lines, there is a technical problem that it is difficult to supply correction voltage levels appropriate to the plurality of data lines.

SUMMARY

An advantage of some aspects of the invention is that it provides an electro-optical device, a method of driving an electro-optical device, and an electronic apparatus capable of displaying high quality images by reducing vertical crosstalk.

According to a first aspect of the invention, there is provided an electro-optical device including: scanning lines; data lines divided into groups of data lines, each group of data lines including N data lines, N being a natural number equal to or greater than three; pixels arranged in correspondence with intersections of the scanning lines and the data lines; output lines which arranged in correspondence with the data lines, the output lines receiving, during a predetermined period, output of a correction voltage having a predetermined voltage level and sequential data voltages for defining gray scale levels of the pixels; and a time division circuit that simultaneously supplies the correction voltage output to the output line to M data lines of each group of data lines, M being a natural number equal to or greater than two and equal to or less than "N−1", the time division circuit performing a time division operation for the sequential data voltages output to the output line and distributing the data voltages which have been acquired by the time division operation to corresponding data lines in each group of data lines.

According to the electro-optical device of the first aspect, during a predetermined period such as one horizontal scanning period, a correction voltage having a predetermined voltage level and sequential data voltages are output to the output lines for the operation thereof. The correction voltage is output in a period preceding a period during which the data voltages are output. The correction voltage output to the output lines is output to the data lines. At this moment, the correction voltage is simultaneously supplied to M data lines among N data lines constituting the group of data lines by the time division circuit. For example, when the group of data lines is constituted by four data lines, each two data lines of the group of data lines are formed as a set, and the correction voltage is simultaneously supplied to each set. The supply of data voltages to data lines other than the above-described M data lines may be performed for each data line or simultaneously for a plurality of data lines. In particular, for example, when N=6 and N=3, data voltages are supplied to six data lines constituting the group of data lines in the order of three data lines, two data lines, and one data line, in the order of one data line, one data line, three data lines, and one data line, or the like. There is a plurality of groups of data lines each having N data lines, and typically, supply of data voltages are performed simultaneously for the plurality of groups of data lines.

When the correction voltage is output, the time division circuit performs a time division operation for the sequential data voltages output to the output line and distributes the data voltages defining gray scale levels of the pixels which have been acquired by the time division operation to one of the plurality of data lines.

In this aspect of the invention, especially, the correction voltage is supplied before the data voltages are supplied to the data lines, and thereby voltages levels of the data lines are formed to be uniform. Accordingly, for example, the vertical crosstalk and the like are reduced, and thereby the display quality can be improved. In addition, since the correction voltage is simultaneously supplied to M data lines, the time required for the supply can be shortened and the number of supplies decreases, compared to a case where the correction voltage is supplied to one data line at a time. Accordingly, it is possible to reduce power consumption of a drive circuit. Furthermore, since the level of the correction voltages simultaneously supplied to M data lines can be changed or controlled (in other words, a voltage level of the correction voltage simultaneously supplied to M data lines and a voltage level of the correction voltage supplied to data lines other than the M data lines can be set to be different), more appropriate correction voltages can be supplied, compared to a case where the correction voltage is simultaneously supplied to the whole data lines. As a result, it is possible to improve the display quality.

As described above, according to the electro-optical device of this aspect of the invention, a high quality display can be made.

In the aspect above, the correction voltage may have a voltage level that does not depend on the gray scale level of the pixel to be displayed.

In such a case, by setting the correction voltage not to be dependent on the gray scale level of the pixel, the correction voltage is not needed to be changed in accordance with the gray scale level of the pixel. Thus, it is possible to prevent a complex configuration of a circuit for outputting the correction voltage. Accordingly, it is possible to suppress or prevent an increase in manufacturing costs or the size of the device.

In the aspect above, correction voltage may have a voltage level that is an average value of the data voltages applied to the M data lines.

In such a case, as the correction voltage, an average value of the data voltages applied to the M data lines is applied. Thus, for example, correction voltages corresponding to data voltages applied to the M data lines may not be set, respectively. In other words, the correction voltages may be set for M data lines instead of each data line. Thus, it is possible to prevent a complex configuration of a circuit for outputting the correction voltage. Accordingly, it is possible to suppress or prevent an increase in manufacturing costs or the size of the device.

In the aspect above, the time division circuit may sequentially distribute the sequential data voltages to the data lines included in the group of the data lines in the order that the correction voltage is supplied.

In such a case, the data voltages are supplied to the data lines in the order that the correction voltage is supplied. Thus, it is possible to reduce or prevent generation of unbalance among the data lines in a period during which the data voltage is supplied after the correction voltage is supplied (that is, a period during which the correction voltage is maintained). Accordingly, it is possible to reduce or prevent the generation of unbalanced voltages among the data lines due to voltage changes in the data lines after supply of the correction voltage.

As described above, according to this aspect, the crosstalk and the like can be effectively suppressed, and thereby it is possible to achieve high-quality display.

In addition, the time division circuit may be configured to change the order that the correction voltage and the sequential data voltages are supplied to the N data lines constituting the group of data lines for each predetermined period.

In such a case, for each predetermined period such as one horizontal scanning period, the order that the correction voltage and the sequential data voltages are supplied to N data lines constituting the group of data lines can be changed. Thus, even in a case where unbalance among the data lines is generated in a period during which the data voltages are supplied after the correction voltage is supplied, the unbalance can be averaged. Accordingly, it is possible to reduce or prevent generation of unbalanced voltages among the data lines. Therefore, it is possible to effectively suppress the vertical crosstalk and the like and to achieve high quality display.

In the aspect above, the time division circuit may supply the correction voltage to the N data lines constituting the group of data lines in a period shorter than a period during which the sequential data voltages are supplied to the N data lines constituting the group of data lines.

In such a case, the correction voltage is supplied to the N data lines constituting the group of data lines in a period shorter than a period during which the sequential data voltages are supplied to the N data lines constituting the group of data lines. In other words, the period during which the data voltages are supplied is longer than the period during which the correction voltage is supplied. Thus, it is possible to acquire a sufficient period for supplying the data voltages in an easy manner. In particular, time limitation on a data line, to which the data voltage is supplied finally, among N data lines can be relieved. Accordingly, the data voltages can be supplied assuredly, and thereby it is possible to achieve high precision display.

According to a second aspect of the invention, there is provided an electronic apparatus including the above-described electro-optical device.

Since the electronic apparatus according to this aspect includes the above-described electro-optical device, it is possible to achieve high quality display by reducing the vertical crosstalk. According to this aspect, various electronic apparatuses such as a projection-type display device, a television set, a cellular phone, an electronic calendar, a word processor, a viewfinder-type or monitor direct view-type video cassette recorder, a workstation, a video phone, a POS terminal, and a touch panel can be implemented. In addition, as the electronic apparatus according to this aspect, for example, an electrophoresis apparatus such as electronic paper, an electronic emission device (Field Emission Display or Conduction Electron-Emitter Display), and a display apparatus using the electrophoresis apparatus or the electronic emission device can be implemented.

According to a third aspect of the invention, there is provided a method of driving an electro-optical device having scanning lines, data lines, pixels arranged in correspondence with intersections of the scanning lines and the data lines, and output lines arranged in correspondence with the data lines, the method comprising: outputting a correction voltage having a predetermined voltage level; simultaneously outputting the output correction voltage to M (where M is a natural number equal to or greater than two and equal to or less than "N−1") data lines from among data lines of one group including N (where N is a natural number equal to or greater than three) data lines; outputting sequential data voltages to the output lines after the correction voltage is output to the output lines; and performing a time division operation for the output sequential data voltages and distributing data voltages defining gray scale levels of the pixels, which have been acquired by the time division operation, to data lines each group of data lines.

According to the method of driving an electro-optical device of this aspect, as in the above-described electro-optical device, the display quality can be improved by reducing the vertical crosstalk and the like. In addition, since the correction voltage is simultaneously supplied to M data lines, the time required for the supply can be shortened and the number of supplies decreases, compared to a case where the correction voltage is supplied to one data line at a time. Accordingly, it is possible to reduce power consumption of a drive circuit. Furthermore, since the level of the correction voltages simultaneously supplied to M data lines can be changed or controlled, more appropriate correction voltages can be supplied, compared to a case where the correction voltage is simultaneously supplied to the whole data lines. As a result, it is possible to improve the display quality. According to the method of driving an electro-optical device of this aspect, a high quality display of the electro-optical device can be made.

In addition, in the method of driving an electro-optical device according to this aspect of the invention, various features described in the above-described electro-optical device may be employed.

The features and other advantages of the present invention will become more apparent from the following embodiments of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings.

First Embodiment

Figure 1:
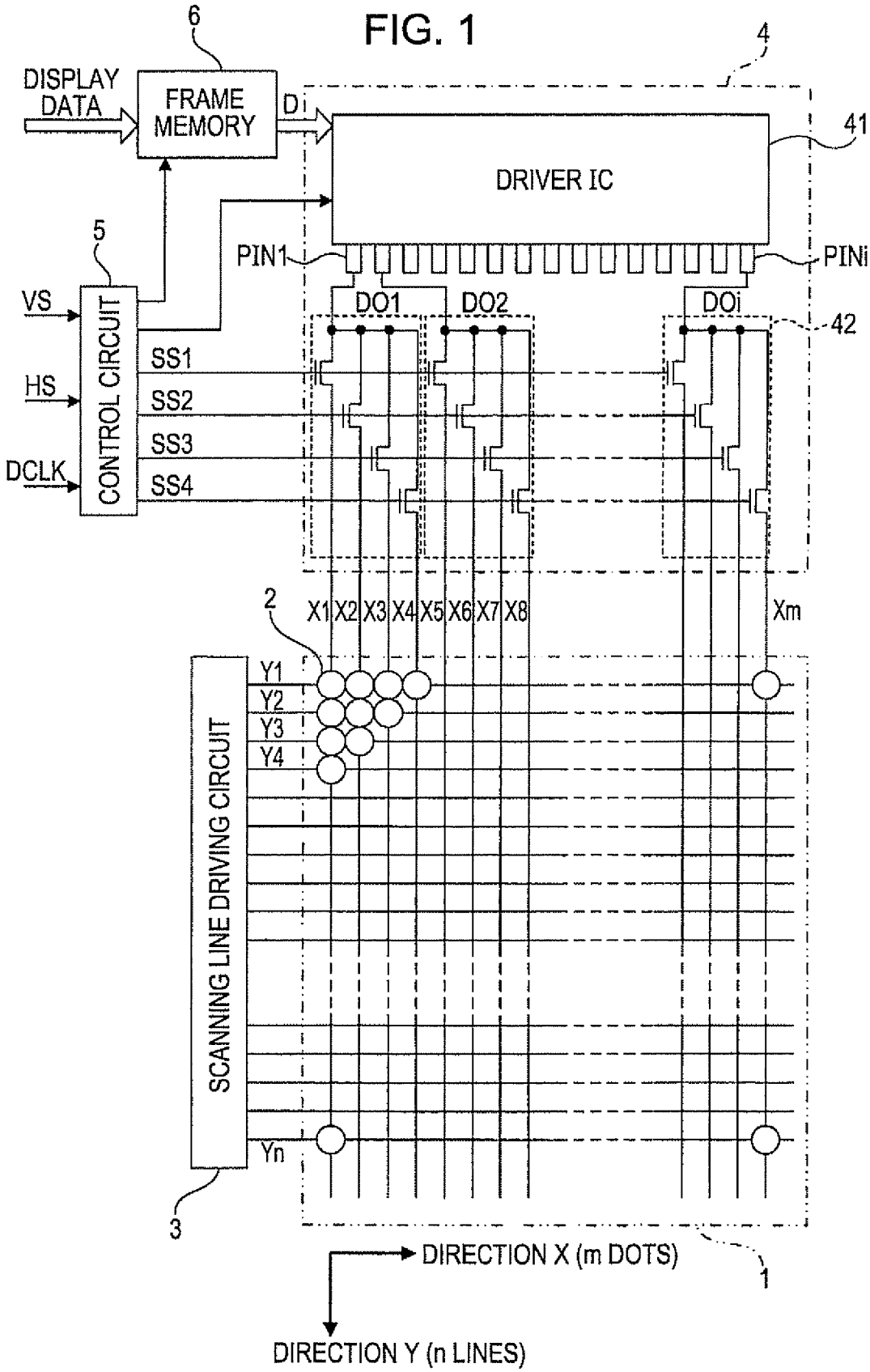
FIG. 1 is a block diagram showing the configuration of an electro-optical device according to a first embodiment of the invention.
Figure 2:
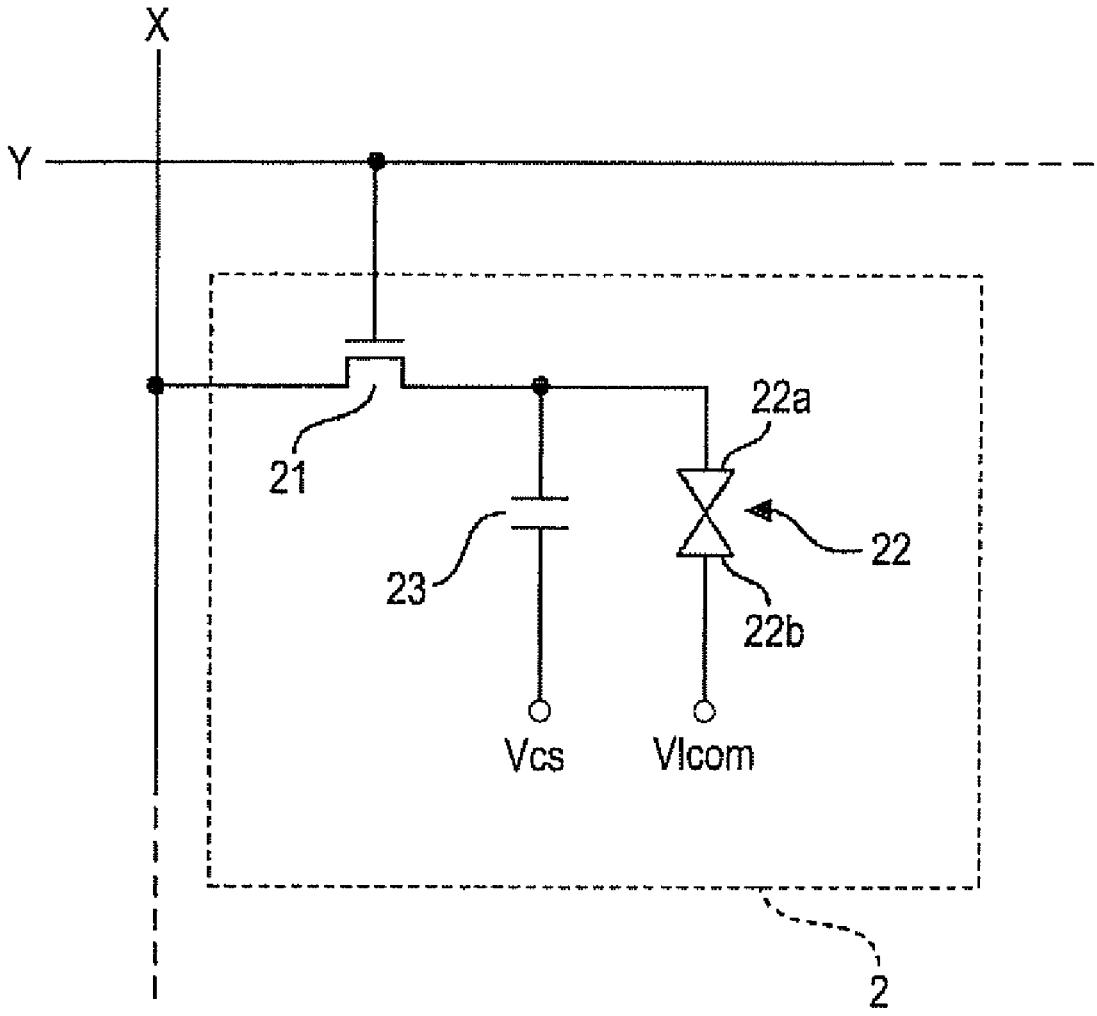
FIG. 2 is an equivalent circuit diagram showing the configuration of a pixel unit according to the first embodiment of the invention.
Figure 3:
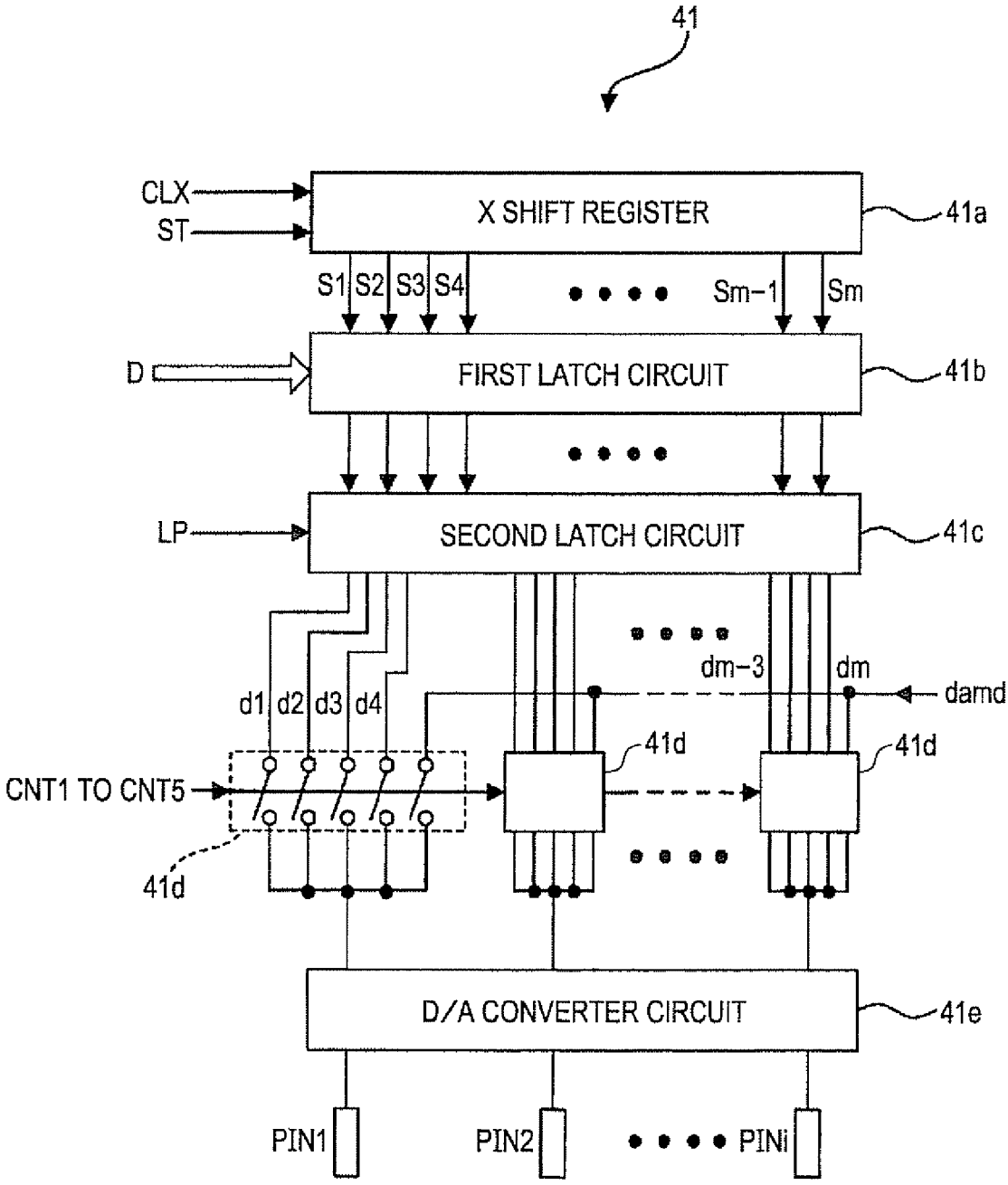
FIG. 3 is a block diagram showing the configuration of a driver IC according to the first embodiment of the invention.
Figure 4:
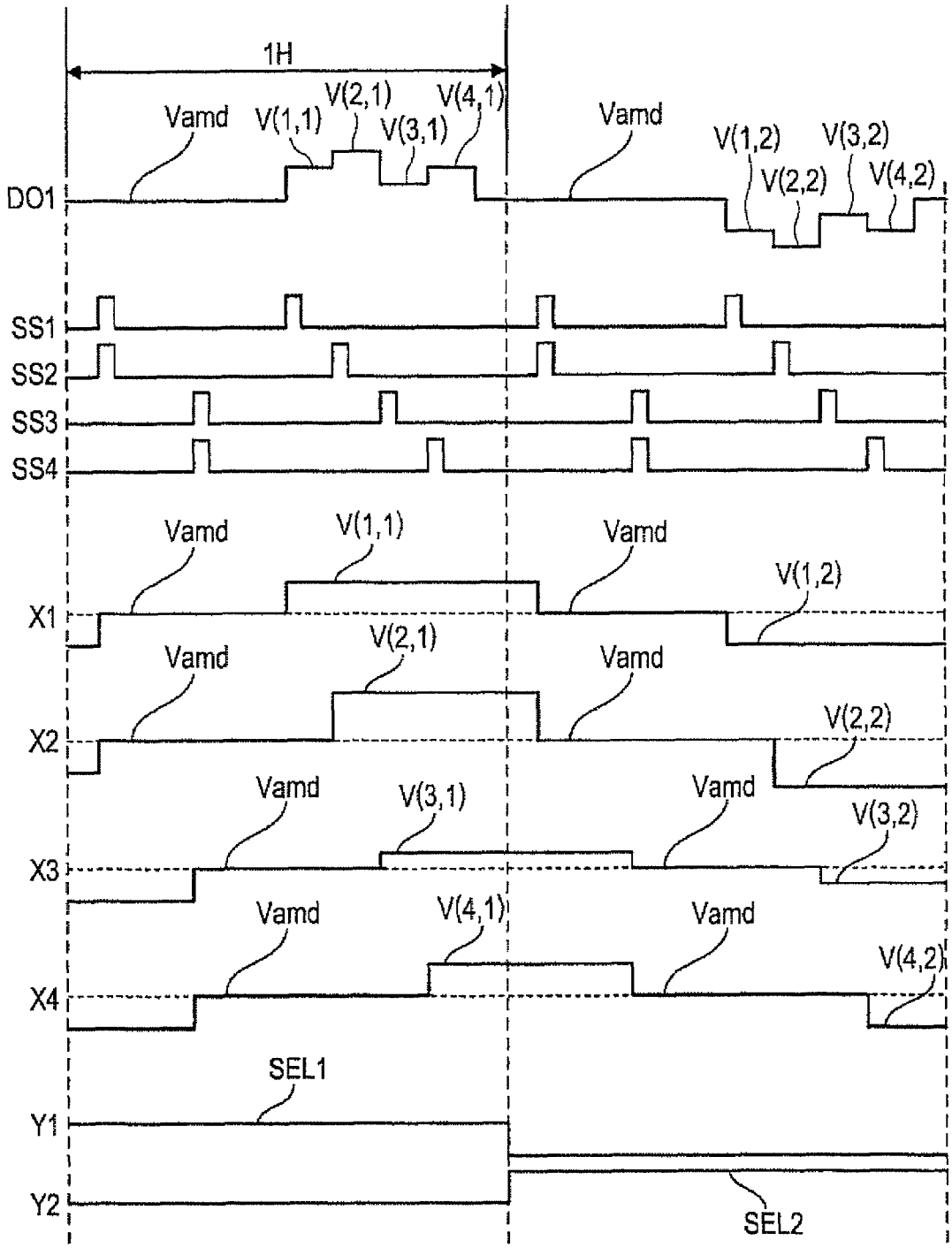
FIG. 4 is a timing chart of a process for time division driving of an electro-optical device according to the first embodiment.

First, an electro-optical device according to a first embodiment of the invention will now be described with reference to FIGS. 1 to 4. FIG. 1 is a block diagram showing the configuration of the electro-optical device according to this embodiment. FIG. 2 is an equivalent circuit diagram showing the configuration of a pixel unit according to this embodiment. FIG. 3 is a block diagram showing the configuration of a driver IC according to this embodiment. FIG. 4 is a timing chart of a process for time division drive in an electro-optical device according to this embodiment.

In FIG. 1, a display unit 1, for example, is an active matrix type display panel that drives a liquid crystal device by using a switching element such as a TFT (Thin Film Transistor). In this display unit 1, pixels 2 corresponding to m dots×n lines are arranged in the shape of a matrix (in a two dimensional plane). In addition, in the display unit 1, N scanning lines Y1 to Yn that extend in a line direction (that is, direction X) and m data lines X1 to Xm that extend in a column direction (that is, direction Y) are arranged, and pixels 2 are disposed in correspondence with intersections of the scanning lines and the data lines. In descriptions below, a pixel 2 of the display unit 1 is specified as an intersection (1 to m, 1 to n) of the data line X and the scanning line Y by using a subscript 1 to m of the data line X and a subscript 1 to n of the scanning line Y. For example, a pixel 2 located on the uppermost left side is (1, 1) and a pixel 2 located on the lowermost right side is (m, n).

As shown in FIG. 2, one pixel 2 is constituted by a TFT 21 serving as a switching element, a liquid crystal capacitor 22, and a storage capacitor 23. The source of the TFT 21 is connected to one data line X, and the gate of the TFT 21 is connected to one scanning line Y. In pixels 2 arranged in a same column, the sources of the TFTs 21 are connected to a same data line X. In addition, in pixels 2 arranged in a same line, the gates of the TFTs 21 are connected to a same scanning line Y. The drain of the TFT 21 is commonly connected to the liquid crystal capacitor 22 and the storage capacitor 23 which are connected in parallel. The liquid crystal capacitor 22 is constituted by a pixel electrode 22*a*, an opposing electrode 22*b*, and a crystal liquid layer pinched by the pixel and opposing electrodes 22*a* and 22*b*. The storage capacitor 23 is formed between the pixel electrode 22*a* and a common capacitor electrode not shown in the figure and is supplied with a voltage level Vcs. Due to the storage capacitor 23, the effect of leakage of charges stored in the liquid crystal is suppressed. To the pixel electrode 22*a* side, a data voltage or the like is applied through the TFT 21, and the liquid crystal capacitor 22 and the storage capacitor 23 are charged or discharged in accordance with the voltage level applied to the pixel electrode 22*a* side. Accordingly, the transmittance of the liquid crystal layer is set on the basis of an electric potential difference (that is, a voltage level applied to the liquid crystal) between the pixel electrode 22*a* and the opposing electrode 22*b*, and a corresponding gray scale level of the pixel 2 is set.

With reference back to FIG. 1, the pixels 2 are driven by using an alternating drive method for inverting the voltage polarity for each predetermined period, so that the operating life of the liquid crystal can be lengthened. The polarity of voltage is defined on the basis of the direction of an electric field applied to the liquid crystal layer, that is, the polarity of the voltage level applied to the liquid crystal layer. In this embodiment, a common DC drive method, as one method of alternating drive, in which the voltage Vlcom applied to the opposing electrode 22*b* and the voltage Vcs applied to the common capacitor electrode are maintained at fixed levels and the polarity of the pixel electrode 22*a* side is inverted is used.

A control circuit 5 controls synchronization of a scanning line driving circuit 3, a data line driving circuit 4, and a frame memory 6 on the basis of external signals such as a vertical synchronization signal Vs, a horizontal synchronization signal Hs, and a dot clock signal DCLK which are input from a higher level device not shown in the figure. Under this synchronization control, the scanning line driving circuit 3 and the data line driving circuit 4 cooperatively control the display operation of a display unit 1. In this embodiment, in order to suppress generation of flicker due to a high speed display operation, a double speed drive method in which a refresh rate (that is, a vertical synchronization frequency) is set to 120 [Hz] that is double a common refresh rate is used. In this case, one frame (that is, 1/60 [Sec]) defined by the vertical synchronization signal Vs is constituted by two fields, and line sequential scanning operations are performed twice during one frame.

The scanning line driving circuit 3 has a shift register, an output circuit, and the like as its primary components. By outputting a scanning signal SEL to the scan lines Y1 to Yn, the scanning lines Y1 to Yn are sequentially selected for each horizontal scanning period (hereinafter, referred to as "1H") corresponding to a period during which one scanning line Y is selected. The scanning signal SEL has binary levels of a high electric potential level (hereinafter, referred to as "level H") and a low electric potential level (hereinafter, referred to as "level L"). The scanning line Y corresponding to a pixel line for data recording is set to level H, and the other scanning lines Y are set to level L. By using this scanning signal SEL, pixel lines for data recording are sequentially selected, and the data recorded in the pixels 2 is maintained over one field.

The frame memory 6 includes at least a memory space of m×n bits corresponding to the resolution of the display unit 1 and stores and maintains display data input from a higher level device in units of frames. A data recording operation for the frame memory 6 and a data reading operation from the frame memory 6 are controlled by a control circuit 5. Here, the display data D for defining the gray scale level of the pixels 2, for example, is 64-gray scale level data constituted by 6 bits of D0 to D5. The display data D read out from the frame memory 6 is serially transferred to the data line driving circuit 4 through a 6-bit bus.

The data line driving circuit 4 arranged in the rear end of the frame memory 6, in cooperation with the scanning line driving circuit 3, outputs data to be supplied to each pixel line for data recording to the data lines X1 to Xm. The data line driving circuit 4 is constituted by a driver IC 41 and a time division circuit 42. The driver IC 41 is arranged separately from the display panel in which pixels 2 are formed in the shape of a matrix, and to i output pins PIN1 to PINi of the driver IC 41, output lines DO1 to DOi are connected. The time division circuit 42 is formed integrally with the display panel by using poly silicon TFTs or the like for reducing the manufacturing cost thereof.

The driver IC 41 outputs data to a pixel line for recording current data and latches (that is, maintains) data of a pixel line for recording the subsequent data by using a dot sequential method, simultaneously. Hereinafter, the configuration and operation of the driver IC 41 will be described in detail.

As shown in FIG. 3, the driver IC 41 includes an X shift register 41*a*, a first latch circuit 41*b*, a second latch circuit 41*c*, a selector switch group 41*d*, and a D/A converter circuit 41*e* as its major circuits. The X shift register 41*a* transmits a start signal ST supplied first in the period 1H in accordance with a clock signal CLK and sets one of latch signals S1, S2, S3, . . . , and Sm to level H and the other latch signals to level L. The first latch circuit 41*b* sequentially latches m pieces of 6-bit data D supplied as serial data in falling edges of the latch signals S1, S2, S3, . . . , and Sm. The second latch circuit 41*c* simultaneously latches data D latched by the first latch circuit 41*b* in a falling edge of a latch pulse LP. The latched m pieces of data D are output in parallel from the second latch circuit 41*c* as data signals d1 to dm, which are digital data, in the subsequent 1H.

The data signals d1 to dm, for example, are divided into sequential groups of four pixels by m/4 (=i) selector switch groups 41*d* arranged in units of four data lines. Here, although one selector switch group 41*d* is shown as a set of five switches, actually one selector switch group includes five channels of 6-bit switch groups. Since the six switches in a same channel operate the same all the time, hereinafter, the six switches will be regarded as one switch for descriptions.

To each selector switch group 41*d*, data signals (for example, d1 to d4) for four pixels which have been output from the second latch circuit 41*c* are input. In addition, to each selector switch group, correction data damd is input. This correction data damd is digital data for defining a voltage level of a correction voltage Vamd to be described later. Five switches constituting each selector switch group 41*d* are controlled to be conducted in accordance with one of four control signals CNT1 to CNT5 and are sequentially turned on at offset timings alternately. Accordingly, the correction data damd and a set of data signals d1 to d4 for four pixels are formed to be sequential in a period 1H in the mentioned order (the order of damd, d1, d2, d3, and d4) and sequentially output from the selector switch group 41*d*.

The D/A (Digital to Analog) converter circuit 41*e* performs a D/A conversion process for a series of digital data output from each selector switch groups 41*d* and generates a voltage level as analog data. Accordingly, the correction data damd is converted into the correction voltage Vamd, the data signals d1 to dm made into sequential signals in units of four pixels are converted into data voltages, and then the data voltages are sequentially output from output pins PIN1 to PINi.

As shown in FIG. 1, to the output pins PIN1 to PINi of the driver IC 41, one of the output lines DO1 to DOi is connected. Four adjacent data lines X are grouped and in correspondence with one output line DO. In addition, between the output lines DO and the grouped data lines X, the time division circuits 42 are disposed for each output line. The grouped four data lines X correspond to a data line group according to an embodiment of the invention, as an example. Each time division circuit 42 includes four selection switches corresponding to the number of grouped data lines X, and each selection switch is controlled to be conducted in accordance with one of the selection signals SS1 to SS4 transmitted from the control circuit 5. The selection signals SS1 to SS4 define an "On" period of the selection signals in a same group and is in synchronization with the sequential signals output from the driver IC 41. Since i time division circuits 42 have a same configuration and all the time division circuits 42 are simultaneously operated in parallel, in descriptions below, only the output line DO1 from which data voltages V1 to V4 are output will be primarily focused for a description.

As shown in FIG. 4, the time division circuit 42 that is connected to the output line DO1 and located on the leftmost side simultaneously supplies the correction voltage Vamd output to the output line DO1 to two data lines X1 and X2 of four data lines X1 to X4. Subsequently, the time division circuit 42 simultaneously supplies the correction voltage Vamd to the remaining two data lines X3 and X4. Simultaneously with the supply of the correction voltage, this time division circuit 42 performs a time-division process for the sequential data voltages V1 to V4 for the four pixels and distributes the acquired data voltages V to one of the data lines X1 to X4. In particular, in the first 1H of one field, the scanning signal SEL1 becomes level H, and thus an uppermost scanning line Y1 is selected. In this period 1H, to the output line DO1, the correction voltage Vamd is output first, and subsequently, data voltages V1 to V4 (in the first 1H, corresponding to V(1, 1), V(2, 1), V(3, 1), and V(4, 1)) for four pixels corresponding to intersections of the data lines X1 to X4 and the scanning line Y1 are sequentially output.

In a state that the correction voltage Vamd is output to the output line DO1, a set of selection signals SS1 and SS2 and a set of selection signals SS3 and SS4 are sequentially set to level H in the mentioned order, and accordingly, four switches constituting the time division circuit 42 are sequentially turned on, two switches at a time. Accordingly, the correction voltage Vamd output to the output line DO1 is sequentially supplied to the data lines X1 to X4, two data lines at a time. In other words, before the data voltages V(1, 1), V(2, 1), V(3, 1), and V(4, 1) are supplied, charging and discharging operations in the data lines X1 to X4 are performed in accordance with the correction voltage Vamd. The correction voltage Vamd is used for reducing the effect of vertical crosstalk. In this embodiment, the correction voltage Vamd is set to a constant value of 0 [V].

Next, in a state that the data voltage V(1, 1) is output to the output line DO1, only the selection signal SS1 is set to level H, and thus, only a switch from among switches constituting the time division circuit 42 corresponding to the data line X1 is turned on. Accordingly, the data voltage V(1, 1) output to the output line DO1, is supplied to the data line X1, and a data recording operation for the pixel (1, 1) is performed in accordance with the data voltage V(1, 1). Since switches corresponding to the data lines X2, X3, and X4 are turned off during the data voltage V(1, 1) is output to the output line DO1, the voltages in the data lines X2, X3, and X4 are maintained at the correction voltage Vamd (precisely, the voltage level decreases by time due to leak).

Subsequently, in a state that the data voltage V(2, 1) is output to the output line DO1, only the selection signal SS2 is set to level H, and thus, only a switch from among switches constituting the time division circuit 42 corresponding to the data line X2 is turned on. Accordingly, the data voltage V(2, 1) output to the output line DO1 is supplied to the data line X2, and a data recording operation for the pixel (2, 1) is performed in accordance with the data voltage V(2, 1). Since switches corresponding to the data lines X1, X3, and X4 are turned off during the data voltage V(2, 1) is output to the output line DO1, the voltage in the data line X1 is maintained at the data voltage V(1, 1), and the data lines X3 and X4 are maintained at the correction voltage Vamd.

Similarly, in a state that the data voltage V(3, 1) is output to the output line DO1, only the selection signal SS3 is set to level H, and thus, only a switch from among switches constituting the time division circuit 42 corresponding to the data line X3 is turned on. Accordingly, the data voltage V(3, 1) output to the output line DO1 is supplied to the data line X3, and a data recording operation for the pixel (3, 1) is performed in accordance with the data voltage V(3, 1). Since switches corresponding to the data lines X1, X2, and X4 are turned off during the data voltage V(3, 1) is output to the output line DO1, the voltage in the data line X1 is maintained at the data voltage V(1, 1), the voltage in the data line X2 is maintained at the data voltage V(2, 1), and the voltage in the data line X4 are maintained at the correction voltage Vamd.

Finally, in a state that the data voltage V(4, 1) is output to the output line DO1, only the selection signal SS4 is set to level H, and thus, only a switch from among switches constituting the time division circuit 42 corresponding to the data line X4 is turned on. Accordingly, the data voltage V(4, 1) output to the output line DO1 is supplied to the data line X4, and a data recording operation for the pixel (4, 1) is performed in accordance with the data voltage V(4, 1). Since switches corresponding to the data lines X1, X2, and X3 are turned off during the data voltage V(4, 1) is output to the output line DO1, the voltage in the data line X1 is maintained at the data voltage V(1, 1), the voltage in the data line X2 is maintained at the data voltage V(2, 1), and the voltage in the data line X3 are maintained at the data voltage V(3,1).

In the next 1H, the scanning signal SEL2 becomes level H, and thus a scanning line Y2 located the second from the upside is selected. In this period 1H, to the output line DO1, the correction voltage Vamd is output first, and subsequently, data voltages V1 to V4 (in this period 1H, corresponding to V(1, 2), V(2, 2), V(3, 2), and V(4, 2)) for four pixels corresponding to intersections of the data lines X1 to X4 and the scanning line Y2 are sequentially output. The process during this period 1H is the same as that during the previous period 1H except for polarity inversion of the voltage output to the output line DO1, and supply of the correction voltage Vamd and distribution of sequential data voltages V(1, 2), V(2, 2), and V(3, 2) are performed. The processes thereafter is the same as that described above, and supply of the correction voltage Vamd and following distribution of sequential data voltages V1 to V4 are performed for each pixel line by using a line sequential method with inverting the polarity for each period 1H until the lowest scan line Yn is selected. In FIG. 4, although an example in which the polarity of the voltage output to the output line DO1 is inverted for each 1H period is shown, also in a case where the polarity is inverted for each field or for each frame, the process is performed similarly.

In addition, for the output line DO2, the same process as that for the output line DO1 described above is performed, except that the voltages to be distributed are V5 to V8 and the data lines to which voltages are distributed are X5 to X8. This feature is the same for other channels until the output line DOi is reached.

The order that the data voltages V(1, 1), V(2, 1), V(3, 1), and V(4, 1) are supplied to the data lines X1 to X4 is set to be associated with the order that the correction voltage Vamd is distributed to the data lines X1 to X4. As shown in FIG. 4, since the order for distributing the correction voltage Vamd is a set of data lines X1 and X2, and a set of data lines X3 and X4, in the process of supplying data voltages V, supply of the data voltages V(1, 1) and V(2, 1) is performed before supply of the data voltages V(3, 1) and V(4, 1) is performed. In this embodiment, although the data voltages are supplied in the order of V(1, 1), V(2, 1), V(3, 1), and V(4, 1), the data voltages may be supplied in the order of V(2, 1), V(1, 1), V(4, 1), and V(3, 1).

As described above, in this embodiment, for an output line DO1 that is arranged in correspondence with a plurality of data lines (for example, X1 to X4), the correction voltage Vamd having a predetermined voltage level and sequential data voltages V1 to V4 are sequentially output in period 1H. The time division circuit 42 sequentially supplies the correction voltage Vamd output to the output line DO1 to the plurality of data lines X1 to X4, two data lines at a time. In addition, the time division circuit 42 performs a time-division process for the sequential data voltages V1 to V4 output to the output line DO1 and distributes the acquired data voltages V to one of the plurality of the data lines X1 to X4. By supplying a same correction voltage Vamd to the data lines X1 to X4, unbalance of average voltages in the data lines X1 to X4 decreases and the average voltages become uniform, when compared to a case where a correction voltage Vamd is not supplied.

Generally, a capacitive coupling exists between the pixel 2 and the data line X, and a leakage current flows therebetween, and accordingly, it is known that a voltage level (voltage level applied to the liquid crystal) recorded in the pixel 2 varies in accordance with a voltage change in the data line X. In addition, it is known that vertical crosstalk generated in a direction along the data line X is a phenomenon caused by unbalanced variances of applied voltage levels for each pixel column. According to this embodiment, before data voltages V are supplied, a same correction voltage Vamd is forcedly supplied to the data lines X1 to X4, and thus unbalance of average voltages in the data lines X1 to X4 decreases. Although the voltages applied to four pixel columns connected to the data lines X1 to X4 vary in accordance with voltage changes in the corresponding data lines X1 to X4, the average voltage levels of the data lines X1 to X4 are formed to be uniform, and accordingly, the applied voltages vary by a same amount. As described above, by forming the variance of the applied voltages to be uniform, the vertical crosstalk cannot be visible, and accordingly, it is possible to improve the display quality.

In addition, although in the above-described embodiment, the correction voltage Vamd is set to 0 [V] which is an approximately median value of data voltages V (drive voltages), the correction voltage may be a combination of an OFF voltage level (0 V) of the liquid crystal and an ON voltage level (5 V or −5 V) of the liquid crystal, the On voltage level (5 V or −5 V), a median voltage level between the ON and OFF voltage levels, or an approximately average voltage level of data voltages applied to the data lines to which the correction voltage Vamd is simultaneously applied (for example, an average of V1 and V2 or an average of V3 and V4). A specific value of the correction voltage may be appropriately set depending on characteristics of a display panel or the characteristics of a TFT. In consideration of complexity of a circuit configuration and the like, it is preferable that the correction voltage Vamd has a voltage level not depending on the gray scale level of the pixel 2 to be displayed. However, the correction voltage level may be set as a variable depending on an average value of the display data D or the like. In addition, the correction voltage level may be alternately shifted to 0 [V] and 5[V] for each predetermined period (for example, 1H). The above-described correction voltage level may be used in other embodiments to be described below.

Second Embodiment

Figure 5:
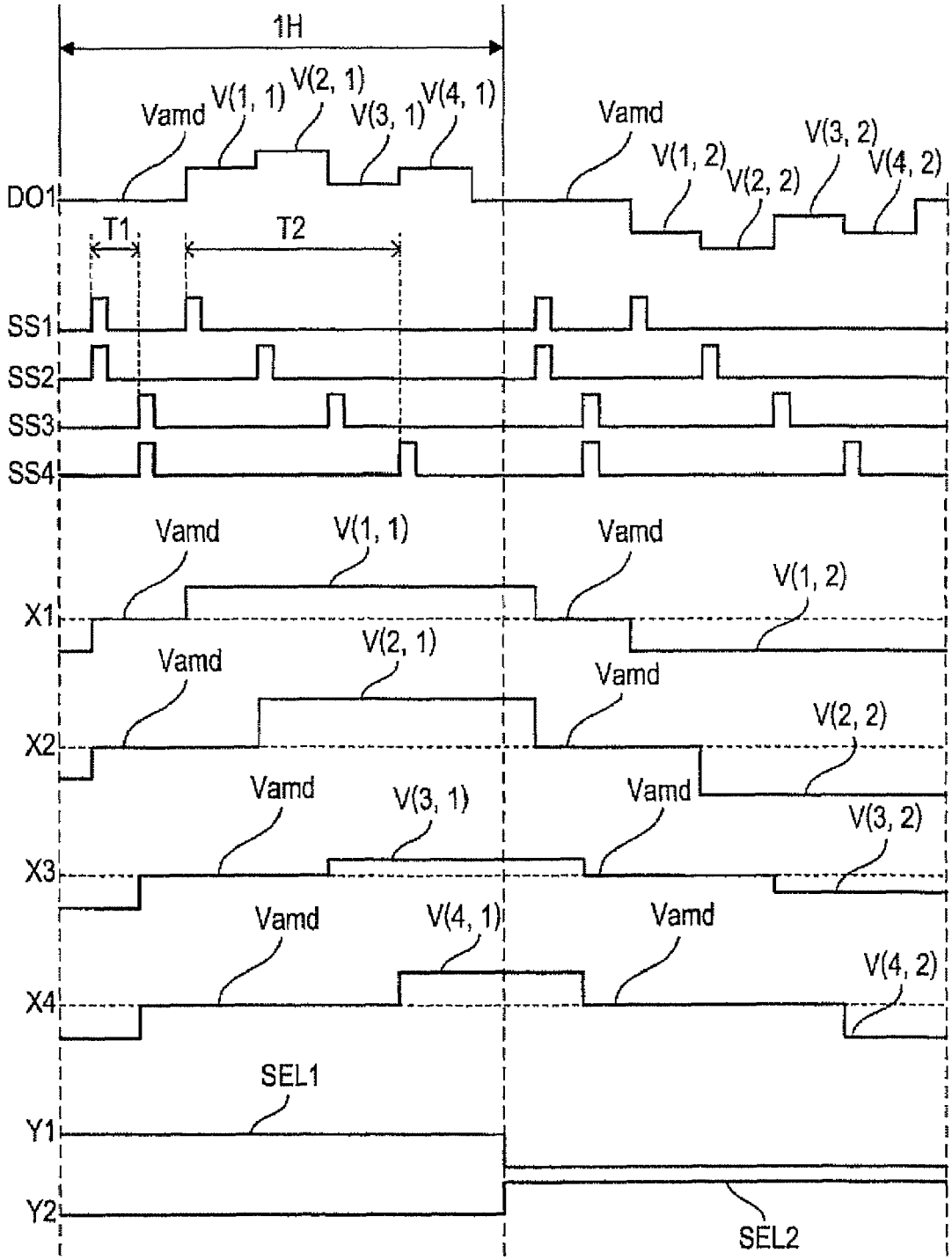
FIG. 5 is a timing chart of a process for time division driving of an electro-optical device according to a second embodiment.

Next, an electro-optical device according to a second embodiment of the invention will be described with reference to FIG. 5. FIG. 5 is a timing chart of a process for time division drive in an electro-optical device according to the second embodiment.

In FIG. 5, the time division circuit 42 sequentially supplies the correction voltage Vamd to the data lines X1 to X4 during a supply period T1 that is shorter than a distribution period T2 during which the sequential data voltage (for example, V1 to V4) is distributed to the data lines X1 to X4. Other features of the second embodiment are the same as those of the above-described first embodiment, and thus, a description thereof is omitted here.

According to this embodiment, by setting the correction voltage supply period T1 to be shorter than the voltage distribution period T2, the data recording period can be easily acquired (especially, the time limitation on the pixel column corresponding to the data line X4 is relieved) on the basis of the shorten supply period T1, and accordingly, it is possible to respond to high precision display in an easy manner.

Third Embodiment

Figure 6:
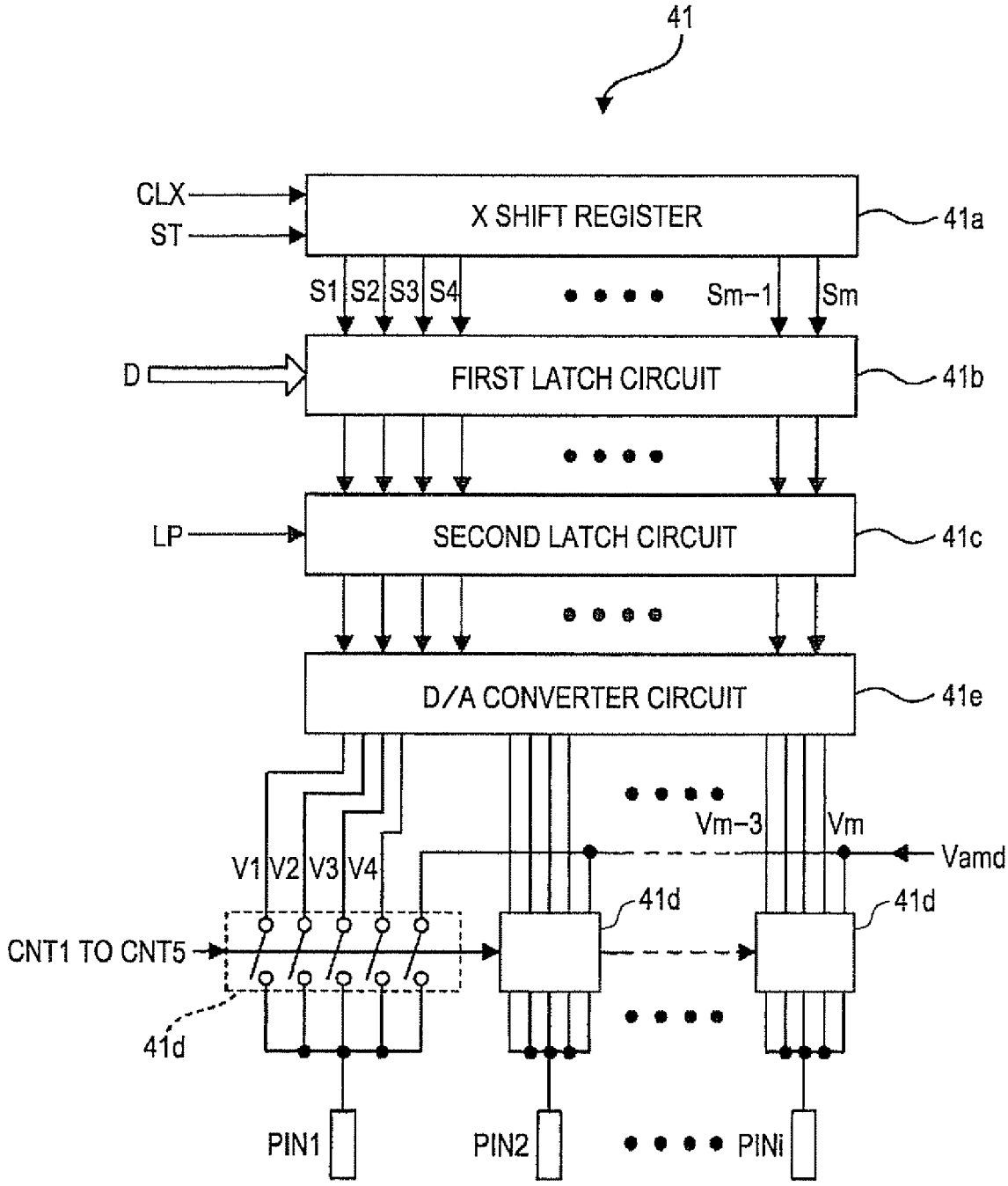
FIG. 6 is a block diagram showing the configuration of a driver IC according to a third embodiment of the invention.

Next, an electro-optical device according to a third embodiment of the invention will be described with reference to FIG. 6. FIG. 6 is a block diagram showing the configuration of the driver IC according to the third embodiment.

As shown in FIG. 6, the configuration of the driver IC 41 has a different from that shown in FIG. 3 that the selector switch groups 41*d* are disposed in the rear end of the D/A converter circuit 41*e*. In addition, since inputs of the selector switch groups 41*d* are analog voltages, each selector switch group 41*d* is constituted by only four switches shown in the figure, which is different from the selector switch group in a case shown in FIG. 3 (that is, a configuration in which 6-bit switch groups are arranged). Other features of the third embodiment are the same as those of the first embodiment, and thus, a same reference code is attached to a same element as that in the first embodiment, and a description thereof is omitted here.

To each selector switch group 41*d*, the correction voltage Vamd along with data voltages (for example, V1 to V4) for four pixels which have been output from the D/A converter circuit 41*e* are input. Five switches constituting each selector switch group 41*d* are controlled to be conducted in accordance with one of five control signals CNT1 to CNT5 and are sequentially turned on at offset timings alternately. Accordingly, the correction voltage Vamd and the data voltages V1 to V4 for four pixels are formed to be sequential in the period 1H in the mentioned order (the order of Vamd, V1, V2, V3, and V4) and output from a corresponding output pin PIN in serial.

According to this embodiment, as in the first embodiment, it is possible to improve the display quality by reducing vertical crosstalk.

Fourth Embodiment

Figure 7:
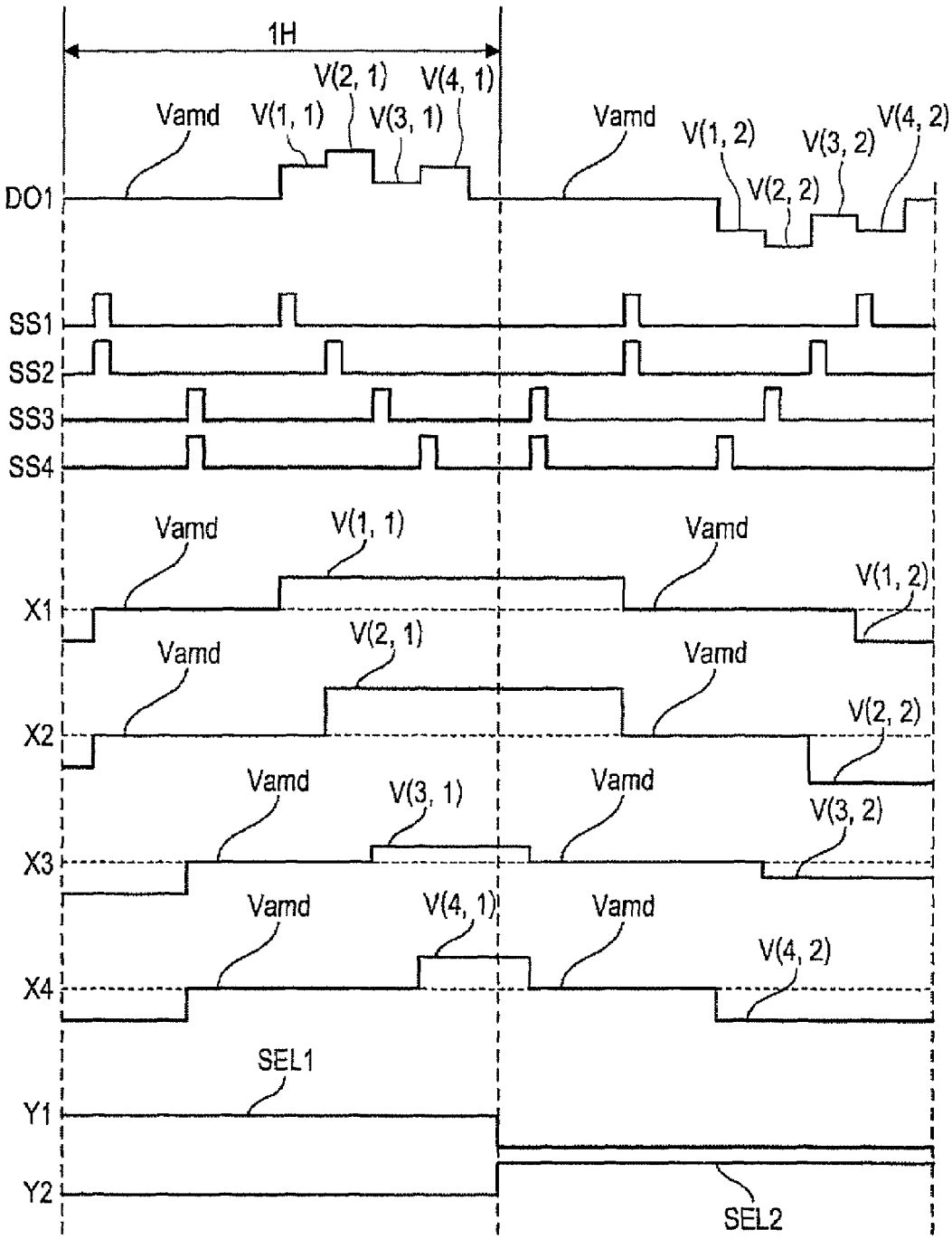
FIG. 7 is a timing chart of a process for time division driving of an electro-optical device according to a fourth embodiment.

Next, an electro-optical device according to a fourth embodiment of the invention will be described with reference to FIG. 7. FIG. 7 is a timing chart of a process for time division drive in the electro-optical device according to the fourth embodiment.

As shown in FIG. 7, by changing the order in selecting switches constituting the time division circuit 42 for each predetermined period (for example, 1H), the order that the correction voltage Vamd and the data voltages V are distributed to the data lines X is changed. Accordingly, the order that the correction voltage Vamd and the data voltages V supplied to output lines DO is reversed for each 1H. Other features of the fourth embodiment are the same as those of the above-described first embodiment, and thus a description thereof is omitted here.

First, during the first 1H, as in the first embodiment, after the correction voltage Vamd, a set of data lines X1 and X2, and a set of data lines X3 and X4 are sequentially supplied to the output line DO1, data voltages V(1, 1), V(2, 1), V(3, 1), and V(4, 1) for four pixels are sequentially supplied in the mentioned order to the output line DO1. During the next 1H, after the correction voltage Vamd, a set of data lines X3 and X4, and a set of data lines X1 and X2 are sequentially supplied to the output line DO1, the data voltages V(2, 2), V(1, 2), V(4, 2), and V(3, 2) for four pixels are sequentially supplied in the mentioned order to the output line DO1.

According to this embodiment, since periods during which voltages of the data lines X1 to X4 are maintained at the correction voltage level Vamd are averaged in the set of the data lines X1 and X2 and in the set of the data lines X3 and X4, it is possible to further improve the display quality, compared to a case where the time division drive sequence shown in FIG. 4 is performed. Referring to the drive process shown in FIG. 4, periods during which voltages of the data lines X1 to X4 are maintained at the correction voltage level Vamd are not the same, and the period in the data line X2 is longer than that in the data line X1, and the period in the data line X4 is longer than that in the data line X3. On the other hand, when the order that the correction voltage Vamd and the data voltages V1 to V4 are distributed to the data lines X1 to X4 is changed for each 1H as in this embodiment, the periods during which the data lines X1 to X4 are maintained at the correction voltage level Vamd can be averaged in the set of the data lines X1 and X2 and in the set of the data lines X3 and X4. Accordingly, a difference in average voltage levels in the data lines X1 to X4 can be effectively reduced, and therefore it is possible to make variances of data recorded in a pixel column connected thereto be further uniform. In other words, by averaging the time for maintaining the correction voltage level Vamd, it is possible to suppress uneven distribution of effects of canceling the crosstalk applied to the data lines X1 to X4.

In this embodiment, although the order that the data voltages V are distributed to the data line X is changed for each period (1H) in which one scanning line Y is selected, the order may be changed for each period (one field) in which all the scanning lines Y1 to Yn are selected, for each period 1H, or for each field.

Fifth Embodiment

Next, an electro-optical device according to a fifth embodiment of the invention will be described with reference to FIG.

Figure 8:
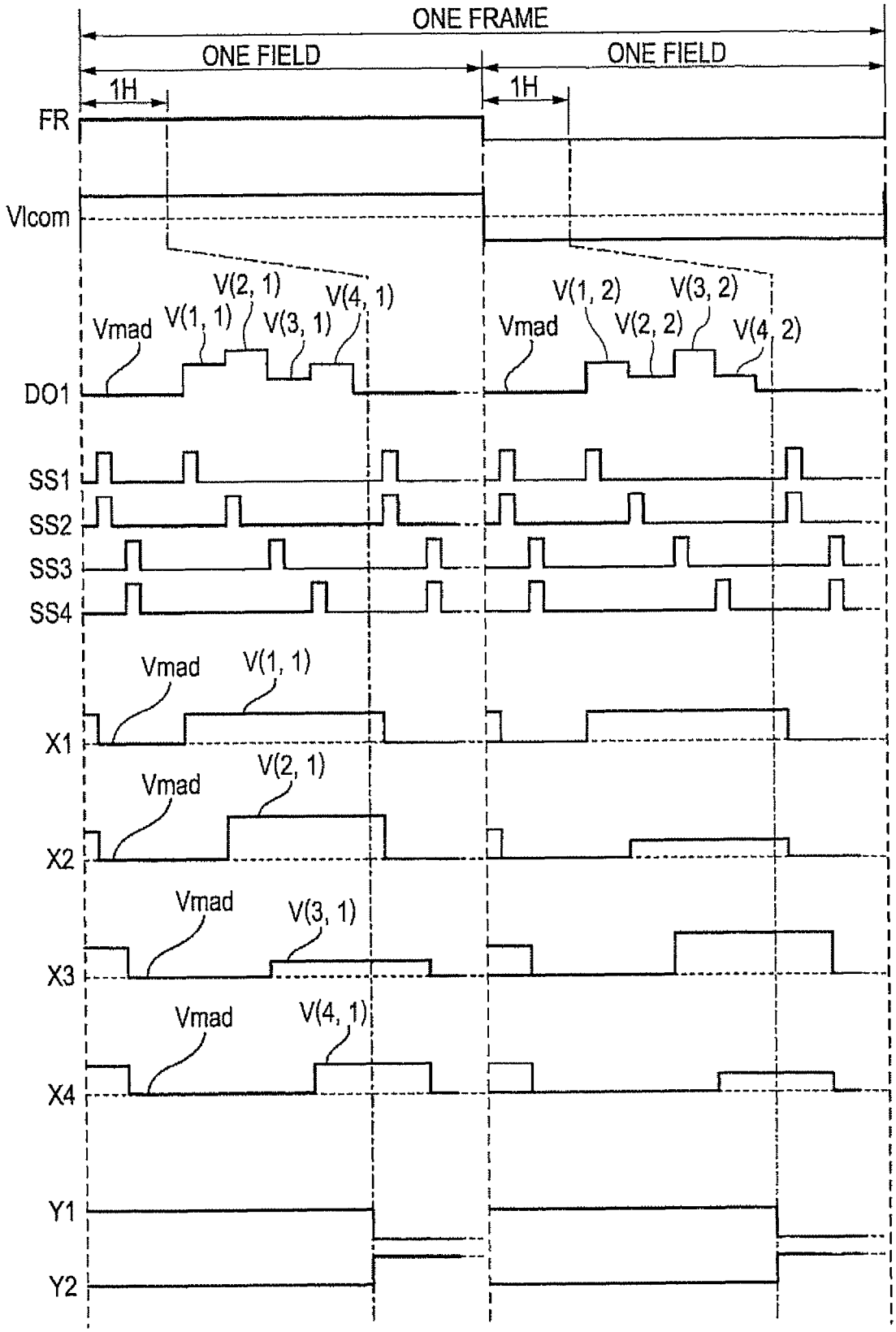
FIG. 8 is a timing chart of a process for time division driving of an electro-optical device according to a fifth embodiment.

8. FIG. 8 is a timing chart for a process for time division drive in the electro-optical device according to the fifth embodiment. In this embodiment, the method of driving the liquid crystal is different from that in the above-described first embodiment, and other configurations and basic operations are the same as those in the first embodiment, and thus, descriptions thereof will be appropriately omitted.

As shown in FIG. 8, the polarity of the voltage Vlcom is regulated in accordance with a polarity indication signal FR and is inverted for each field. The correction voltage Vamd is maintained at a substantially same voltage level (0 [V]) even when the polarity is inverted. In other words, this embodiment uses a common AC driving method, in which the voltage Vlcom applied to the opposing electrode 22*b* is set to be variable, as one of alternating current driving methods for a liquid crystal.

According to this embodiment, as in the above-described embodiments, by outputting the correction voltage Vamd, the vertical crosstalk can be reduced, and thereby it is possible to improve the display quality.

In the above-described embodiments, although an example in which a time division drive process for dividing each data voltage into four divisions is performed by the time division circuit 42 has been described, however, a time division drive process for dividing each data voltage into divisions of any arbitrary number such as three divisions, five divisions, six divisions, seven divisions, or eight divisions may be performed. In such a case, the drive process can be performed similarly.

Electronic Apparatus

Figure 9:
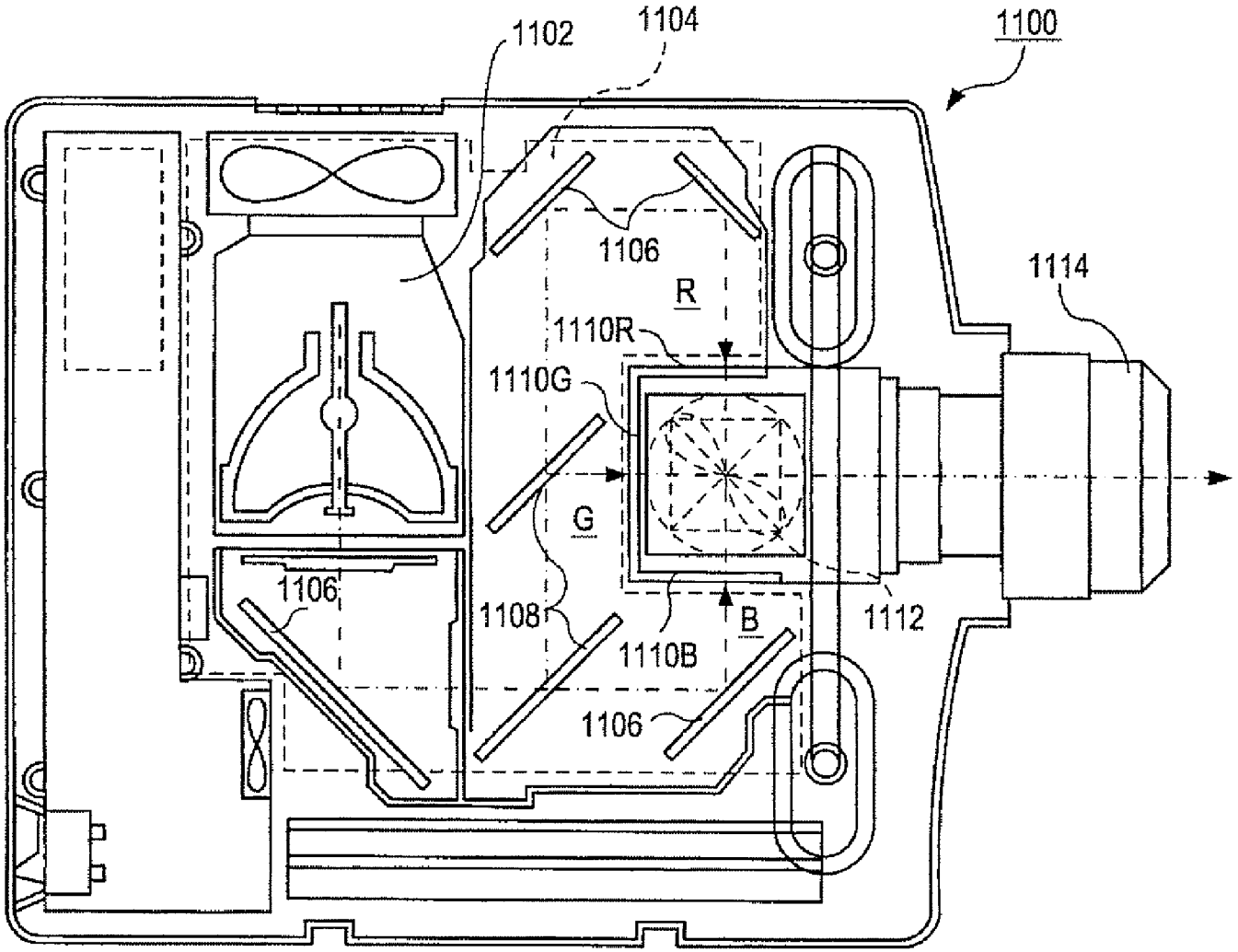
FIG. 9 is a plan view showing the configuration of a projector as an example of an electronic apparatus having the electro-optical device.

Hereinafter, a projector in which the above-described liquid crystal device, which is an electro-optical device, is used as a light valve will be described. FIG. 9 is a plan view showing the configuration of the projector, as an example.

As shown in FIG. 9, inside the projector 1100, a lamp unit 1102 including a white light source such as a halogen lamp is disposed. The projection light emitted from the lamp unit 1102 is divided into three primary colors of R, G, and B by four mirrors 1106 and two dichroic mirrors 1108 disposed inside a light guide 1104, and the divided projection light is incident on liquid crystal panels 1110R, 1110B, and 1110G serving as light valves corresponding to the primary colors.

The liquid crystal panels 1110R, 1110B, and 1110G have structures equivalent to that of the above-described liquid crystal device and are driven in accordance with signals of primary colors of R, G, and B supplied from an image signal processing circuit. The light modulated by the liquid crystal panels is incident on a dichroic prism 1112 from three directions. In the dichroic prism 1112, the light of R and B is refracted by 90 degrees and the light of G progresses straight. Accordingly, a composed image of images of the primary colors is projected on a screen or the like through a projection lens 1114.

Here, when display images displayed by the liquid crystal panels 1110R, 1110B, and 1110G are considered, the display image displayed by the liquid crystal panel 1110G needs to be inverted to left-to-right/right-to-left side with respect to the display images displayed by the liquid crystal panels 1110R and 1110B.

Since light corresponding to primary colors of R, G, and B is incident on the liquid crystal panels 1110R, 1110B, and 1110G by using the dichroic mirror 1108, a color filter is not required.

Furthermore, the present invention may be applied not only to the electronic apparatus described with reference to FIG. 9, but also to a mobile type personal computer, a cellular phone, a liquid crystal TV, a viewfinder-type or monitor direct view-type video cassette recorder, a car navigator, a pager, an electronic diary, a calculator, a word processor, a workstation, a video phone, a POS terminal, an apparatus having a touch panel, or the like.

The present invention may be applied to a reflection-type liquid crystal device (LCOS) in which elements are formed on a silicon substrate, a plasma display panel (PDP), a field emission display (FED or SED), an organic EL display, a digital micro-mirror device (DMD), an electrophoresis apparatus, or the like, along with the above-described liquid crystal device.

The present invention is not limited to the above-described embodiments, and thus any change or modification can be made therein without departing from the scope of the gist or idea of the invention which can be read from the following claims or the whole specification. An electro-optical device, a method of driving an electro-optical device, and an electronic apparatus having the electro-optical device in which such a change or modification is made also belongs to the technical scope of the invention.

The entire disclosure of Japanese Patent Application No. 2007-062978, filed Mar. 13, 2007 is expressly incorporated by reference herein.

What is claimed is:

1. An electro-optical device comprising:

scanning lines;

data lines divided into groups of data lines, each group of data lines including N data lines, N being a natural number equal to or greater than three;

pixels arranged in correspondence with intersections of the scanning lines and the data lines;

output lines arranged in correspondence with the data lines, the output lines receiving, during a predetermined period, output of a correction voltage having a predetermined voltage level and sequential data voltages for defining gray scale levels of the pixels; and a time division circuit that simultaneously supplies the correction voltage output to the output line to a sub-group of M, M being a natural number equal to or greater than two and equal to or less than "N−1", data lines of each group of N data lines and that then simultaneously supplies the correction voltage output to the output line to a different sub-group of M data lines of each group of N data lines, the time division circuit performing a time division operation for the sequential data voltages output to the output line and distributing the data voltages which have been acquired by the time division operation to corresponding data lines in each group of data lines.

2. The electro-optical device according to claim 1, wherein the correction voltage has a voltage level that does not depend on the gray scale level of the pixel to be displayed.

3. The electro-optical device according to claim 1, wherein the correction voltage has a voltage level that is an average value of the data voltages applied to the M data lines.

4. The electro-optical device according to claim 1, wherein the time division circuit sequentially distributes the sequential data voltages to the data lines included in the group of the data lines in the order that the correction voltage is supplied.

5. The electro-optical device according to claim 4, wherein the time division circuit changes the order that the correction voltage and the sequential data voltages are supplied to the N data lines constituting the group of data lines for each predetermined period.

6. The electro-optical device according to claim 1, wherein the time division circuit supplies the correction voltage to the N data lines constituting the group of data lines in a period shorter than a period during which the sequential data voltages are supplied to the N data lines constituting the group of data lines.

7. An electronic apparatus comprising the electro-optical device according to claim 1.

8. A method of driving an electro-optical device having scanning lines, data lines, pixels arranged in correspondence with intersections of the scanning lines and the data lines, and output lines arranged in correspondence with the data lines, the method comprising:

outputting a correction voltage having a predetermined voltage level;

simultaneously outputting the output correction voltage to a sub-group of M, M being a natural number equal to or greater than two and equal to or less than "N−1", data lines from among data lines of one group including N, N being a natural number equal to or greater than three, data lines and then simultaneously outputting the output correction voltage to a different sub-group of M data lines from among data lines of one group including N;

outputting sequential data voltages to the output lines after the correction voltage is output to the output lines; and performing a time division operation for the output sequential data voltages and distributing data voltages defining gray scale levels of the pixels, which have been acquired by the time division operation, to data lines in each group of data lines.

* * * * *